US006009880A

United States Patent [19]

Weidlich

[11] Patent Number: 6,009,880

[45] Date of Patent: Jan. 4, 2000

[54] NAIL CLIPPING RETAINING DEVICE

[76] Inventor: Robert D. Weidlich, 28 Kory Dr., Kendall Park, N.J. 08824

[21] Appl. No.: 09/215,807

[22] Filed: Dec. 18, 1998

[51] Int. Cl.[7] ..... A45D 29/18

[52] U.S. Cl. ..... 132/75.4; 132/73; 132/75; 30/28

[58] Field of Search ..... 132/73, 75, 75.4, 132/75.5, 73.5; 30/26, 27, 28, 29, 124; D28/56, 60, 62

[56] References Cited

U.S. PATENT DOCUMENTS

| | | | |
|---|---|---|---|
| D. 283,452 | 4/1986 | Boschetti | D28/62 |
| D. 309,038 | 7/1990 | Ladora | D28/60 |
| D. 313,874 | 1/1991 | Schulz | D28/60 |
| 2,887,773 | 5/1959 | Killen . | |
| 2,970,376 | 2/1961 | Kuo . | |
| 2,995,820 | 8/1961 | Pocoski . | |
| 3,013,334 | 12/1961 | Bassett | 30/28 |
| 3,031,754 | 5/1962 | Pocoski . | |
| 3,154,850 | 11/1964 | Okuno | 30/28 |
| 3,169,312 | 2/1965 | Fink | 30/20 |
| 3,188,737 | 6/1965 | Chase | 30/124 |
| 3,986,257 | 10/1976 | Kiura | 30/28 |
| 4,062,109 | 12/1977 | Min | 30/28 |
| 4,380,120 | 4/1983 | Hannon | 30/28 |
| 4,640,011 | 2/1987 | Gamble | 30/20 |
| 4,934,050 | 6/1990 | Athalye | 132/75 X |
| 4,982,747 | 1/1991 | Shah | 132/75.5 |
| 4,996,771 | 3/1991 | Williams | 30/28 |
| 5,010,644 | 4/1991 | Goench | 30/28 |
| 5,072,511 | 12/1991 | Ro | 30/20 |
| 5,131,146 | 7/1992 | Leininger | 132/75.5 X |
| 5,195,544 | 3/1993 | Campagna | 132/75.5 |
| 5,261,160 | 11/1993 | Castagna | 30/20 |

FOREIGN PATENT DOCUMENTS

| | | | |
|---|---|---|---|
| 2682018 | 4/1993 | France | 30/28 |
| 2153220 | 8/1985 | United Kingdom | 132/73 |

*Primary Examiner*—Gene Mancene
*Assistant Examiner*—Pedro Philogene
*Attorney, Agent, or Firm*—Gary N. Lipson

[57] ABSTRACT

A nail clipper retaining device is disclosed for retaining nail clippings within a typical nail clipper. The device utilizes as a fastening system, a universal slotted mounting located at the bottom of the u-shape channel. The slotted mounting catch slides into position between the head of the lever arm pivot pin and the lower stationary spring member of the typical nail clipper. The force between the head of the lever arm pivot pin and lower stationary spring member of the initially loaded compressive cutting mechanism of the typical nail clipper secures the retaining device to the lower spring member. The device can be easily and effortlessly mounted and dismounted for the purpose of evacuating accumulated nail clippings, cleaning and sterilization.

8 Claims, 3 Drawing Sheets

NAIL CLIPPING RETAINING DEVICE

BACKGROUND

This invention relates to fingernail and toenail clippers, specifically to nail clipping retaining devices that mount to nail clippers to prevent the annoying and unsanitary scattering of nail clippings during the manicuring procedure.

DESCRIPTION OF PRIOR ART

A typical nail clipper of the class which includes U.S. Pat. No. 3,013,334, issued Aug. 29, 1960 to Henry W. Bassett, consist of a pair of oppositely bowed spring members, an upper movable member and a lower stationary member. These spring members are joined together at one end by a weld or rivet, creating a spring mechanism when the opposite end of the spring members are compressed, creating a joined end and a free end. On most nail clippers, at the joined end, a rivet secures a pivoting nail file to the clipper. At the free end of the mechanism, opposing cutting jaws are coupled together by a lever arm pivot pin and a lever arm with a built in fulcrum. The pivot pin passes through both spring members via aligned holes near the cutting jaws at the free end, with the holes being slightly larger than the shaft of the pivot pin and the head of the pivot pin engaging the lower stationary spring member. The fulcrumed lever arm is then connected to the pivot pin above the upper movable member under the spring force of both compressed spring members creating an initially loaded compressive cutting mechanism. The head of the lever arm pivot pin prevents the pin from being pulled through the aligned hole in the lower stationary spring member when the fulcrumed lever arm is depressed.

With the aforementioned nail clipper design, the nail clippings shoot through the openings between the spring members and fly about the room in a random manner.

An exorbitant amount of time, energy and money has been spent trying to solve the annoying and unsanitary problem of nail clipping projectiles flying about the room during the manicuring process. There are more than fifty patents related to nail clipping retaining devices. Each of these devices has certain drawbacks that have inhibited their marketing and manufacturing feasibility.

After an examination of the prior art, five common methods of mounting the retaining devices were found:

1. Small plastic tabs that fasten the retaining device to the lower stationary spring member of the nail clipper.
2. Fasteners such as rivets which connect the retaining device to the nail clipper via holes in the spring members.
3. Rubber pouch retainers that are inserted between both spring members at the cutting end of the nail clipper and circumvent the lever arm pivot pin as a fastening means.
4. Full enclosures, usually manufacture of rubber, which slide over both spring members and elastically fasten to the nail clipper.
5. Fixed retainers which are either part of the lower stationary spring member or have a fastening hole which fits between the head of the lever arm pivot pin and the lower stationary spring member during the initial assembly of the nail clipper.

An examination of the prior art also suggested the following manufacturing and marketing issues:

1. The ability or ease of mounting and dismounting the retaining device for the purpose of emptying accumulated nail clippings, cleaning and sterilization.

2. Costly redesigns of conventional nail clippers with fixed retaining devices and mechanical apparatuses to increase ease of emptying.
3. Retaining devices of plastic that fasten to only one particular nail clipper design, relying on exact dimensions of the nail clipper and utilize a variety of different mounting methods.

Each device described performs the same function, the prevention of nail clippings from being strewn about, but none of the fastening methods discussed allow ease of mounting and dismounting for the purpose of emptying accumulated nail clippings, cleaning and sterilization of the device.

The following patents fall under category 1 previously defined for nail clipping retaining devices that are difficult or impossible to dismount:

U.S. Pat. No. 2,995,820 issued Jun. 23, 1958 and U.S. Pat No. 3,031,754 issued Aug. 15, 1961 to Pocoski, U.S. Pat. No. 3,169,312 issued Mar. 25, 1963 to Charles H. Fink, U.S. Pat. No. 3,188,737 issued Jun. 15, 1965 to P. J. Chase, and U.S. Pat. No. 4,062,109 issued Dec. 13, 1977 to Mana Min.

The following patents fall under category 2 previously defined for costly re designs of the conventional nail clipper with fixed retaining devices and elaborate actuating mechanisms which attempt to increase openings between cutting jaws to allow ease of emptying ac cumulated nail clippings.

U.S. Pat. No. 3,986,257 issued Oct. 19, 1976 to Masao Kiura, U.S. Pat. No. 5,072,511 issued Dec. 17, 1991 to Abraham E. Ro, and U.S. Pat. No. 5,261,160 issued Nov. 16, 1993 to Leonardo F. Campagna.

The following patents fall under category 3 previously defined for retaining devices which rely on small plastic tabs to secure the retaining device to specifically designed nail clippers and can not be interchanged between different manufacturers nail clippers because of dimensional restraints:

U.S. Pat. No. 2,887,773 issued Jun. 6, 1957 to Donald P. Killen, U.S. Pat. No. 2,970,376 issued Mar. 16, 1960 to Chi Sheng Kuo, U.S. Pat. No. 4,380,120 issued Apr. 19, 1983 to William Hannon. U.S. Pat. No. 4,640,011 issued Feb. 3, 1987 to William L. Gamble, U.S. Pat. No. 5,195,544 issued Mar. 23, 1993 to Vince Campagna.

In particular, it should be noted that the Hannon patent teaches a device that is constructed of plastic material. In one embodiment, the Hannon device is held onto the lower arm by means of projections 44a and 46a as shown in FIG. 4. The Hannon patent also teaches an alternate method of securing the nail clipping retaining device by means of applying adhesive strips to keep the clipping retainer affixed to the lower arm of the nail clipper.

OBJECTS AND ADVANTAGES

The main object of this invention is to provide both individuals and industry with a nail clipping retaining device that prevents annoying and unsanitary scattering of nail clippings during a manicuring process and further provide a means of removing the device easily and effortlessly from the nail clipper for the purpose of evacuating accumulated nail clippings, cleaning and sterilization.

Another object of this invention is to provide a nail clipping retaining device which utilizes a universal slotted mounting catch to retrofit most existing nail clipper designs available.

Still another object of this invention is to provide industry with a nail clipping retaining device for use in professional salons and offices that can be sterilized by all modalities of sterilization. Nail technicians are required to sterilize all implements after each client to prevent the spread of infectious diseases such as AIDS, hepatitis and nail funguses. Professional manicurists, Podiatrists, hospitals, nursing homes and the military all have need for a nail clipping retaining device which is both effective and sanitary.

Another advantage of this invention over the prior art is its contouring thin design which allows a person to carry the nail clipper with the retaining device in ones pocket where as most of the nail clipping retaining devices are to bulky to do so.

The unique and novel advantage of this invention over the prior art is that the device is made out of metal and utilizes a method of fastening the device to the nail clipper. By utilizing a universal slotted mounting catch as a means of fastening a nail clipping retaining device to a nail clipper, one common design of the device can retrofit to many different manufacturers nail clippers. This advantage over the prior art allows the device to be sold separately or in conjunction with a nail clipper.

BRIEF DESCRIPTION OF THE INVENTION

A unique and novel aspect of this invention is its design and mounting method. The nail clipping retaining device consists of a u-shaped elongated channel with a central bottom section and two vertical side sections engineered to cover side openings of a conventional nail clipper to prevent the annoying and unsanitary scattering of nail clippings during the manicuring process.

The device utilizes as a fastening system, a slotted mounting catch in the central bottom section of the u-shape channel. This slotted mounting catch slides into position between the head of the lever arm pivot pin and the lower stationary spring member of a typical nail clipper. The force between the head of the lever arm pivot pin and lower stationary spring member of the initially loaded compressive cutting mechanism of a typical nail clipper secures the retaining device tightly to the lower spring member. The device can be easily and effortlessly mounted and dismounted for the purpose of evacuating accumulated nail clippings, cleaning and sterilization.

To mount the retaining device to a nail clipper, one positions the retaining device on the lower stationary member of the nail clipper behind the lever arm pivot pin and slides the retaining device under the head of the lever arm pivot pin. The device slides into position with a snap and once coupled to the nail clipper, the retaining device is secured in check by the nail file mounting rivet which passes through the spring members at the opposite end.

To dismount the retaining device from a nail clipper, one raises the rear of the device slightly to clear the protruding rivet on the nail clipper and slides the device from under the head of the lever arm pivot pin. The nail clippings accumulate within the nail clipper and are dumped out via the opening between the jaws.

After the manicure is completed, the retaining device is removed and all remaining nail clippings are cleared from between the spring members. At this point, the nail clipper and retaining device can be sterilized to prevent infection. The retaining device may then be remounted to the nail clipper for future use.

BRIEF DESCRIPTION OF THE DRAWINGS

These and other features, aspects, and advantages of the present invention will become better understood with regard to the following description, appended claims, and accompanying drawings where:

PARTS LIST

Figure 1:
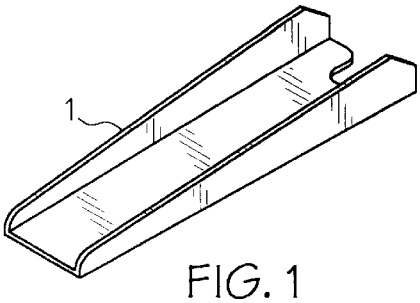
FIG. 1 is a perspective drawing of a nail clipping retaining device, according to the present design.

1. Nail clipping retaining device
2. Upper movable spring member
3. Lower stationary spring member
4. Joined end
5. Upper cutting jaw
6. Lower cutting jaw
7. Free end
8. Lever arm pivot pin
9. Head of lever arm pivot pin
10. Fulcrumed lever arm
11. Pivoting mail file
12. Rivet
13. Nail file pivot stabilizing tabs
21. Typical nail clipper
22. Universal slotted mounting catch
27. Alternate variation of typical nail clipper

Detailed Description

Figure 2:
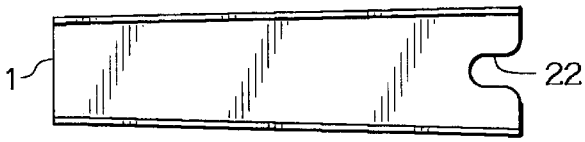
FIG. 2 is a top view thereof.
Figure 3:
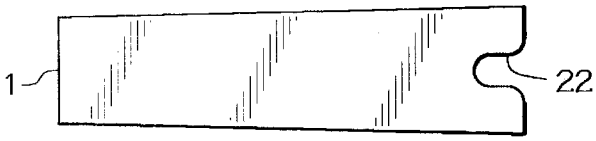
FIG. 3 is a bottom view thereof.
Figure 4:
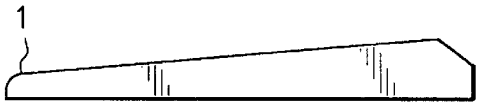
FIG. 4 is a side elevation view and it is noted that the right and left side views are equivalent thereof.
Figure 5:
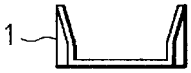
FIG. 5 is a rear view thereof.
Figure 6:
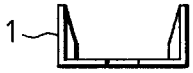
FIG. 6 is a front view thereof.

For a more complete understanding of the present invention and for further objects and advantages thereof, reference may now be had to the following description taken in conjunction with the accompanying drawings in which:

FIG. 1 shows a prospective view of the nail clipping retaining device 1. FIG. 2, is a top view of the device 1 including a universal slotted mounting catch 22. FIG. 3 is a bottom view of the device 1, FIG. 4 is a side view of the device 1, FIG. 5 is a rear view of the device 1, and FIG. 6 is a front view of the device.

Figure 7:
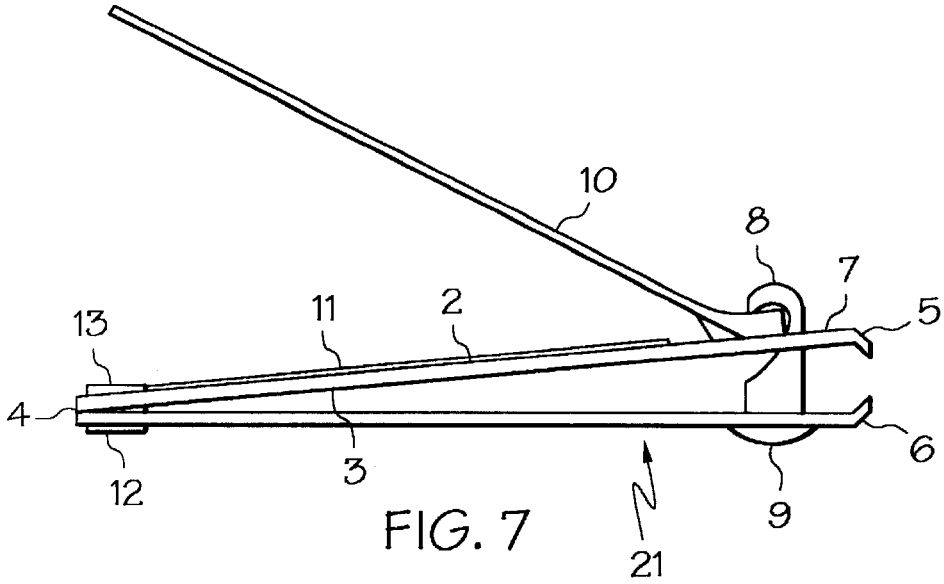
FIG. 7 is a side view of a typical nail clipper.

FIG. 7 shows a side view of a typical nail clipper 21 of the class which includes a pair of oppositely bowed spring members, an upper movable spring member 2 and lower stationary spring member 3, typically joined together at end 4 by a rivet 12 and having a pair of curved opposing cutting jaws 5 and 6 at the opposite end 7. A lever arm pivot pin 8 passes through aligned holes in members 2 and 3, and head 9 of pin 8 engages stationary member 3, with the aligned holes being larger than the shaft of pin 8 and smaller than head 9 of pin 8. Under the opposing spring force of members 2 and 3, pin 8 is coupled to a fulcrumed lever arm 10 above member 2. At end 4, a pivoting nail file 11 is coupled to member 2 and 3 by rivet 12. File 2 contains a pair of upright stabilizing tabs 13, between which lever 10 fits when folded in the closed position to prevent file 11 from pivoting open.

Figure 8:
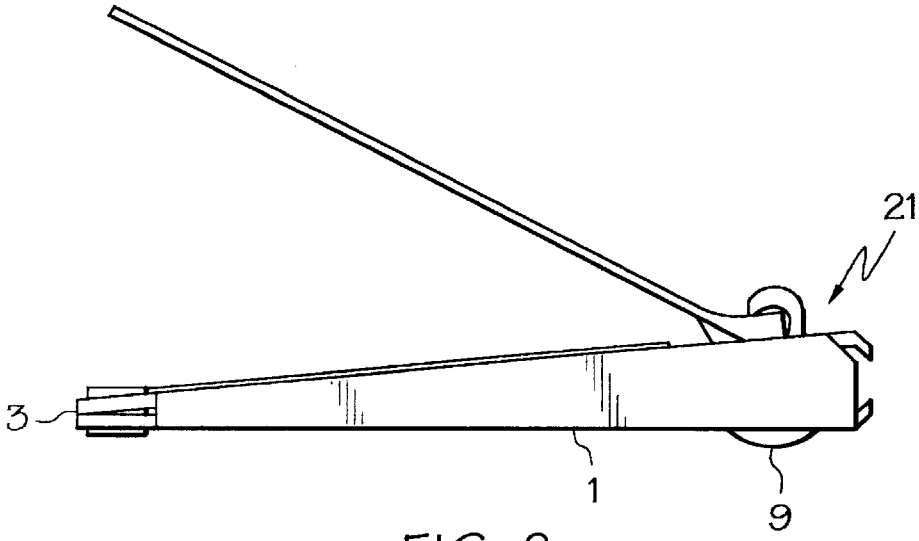
FIG. 8 is a side view of a typical nail clipper with the nail clipping retaining device mounted in position.

FIG. 8 shows a side view of nail clipper 21 together with a nail clipping retaining device 1 mounted between stationary member 3 and head 9.

Figure 9:
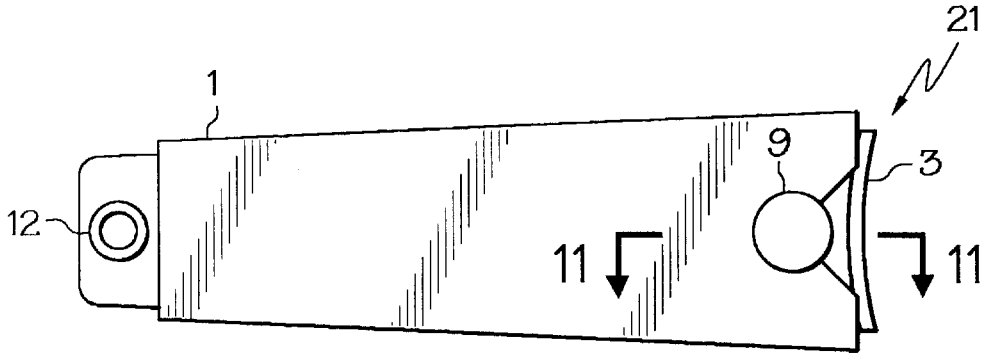
FIG. 9 is a bottom view thereof.

FIG. 9 depicts a bottom view of a nail clipper 21 together with a nail clipping retaining device 1 that is mounted to the nail clipper 21.

Figure 10:
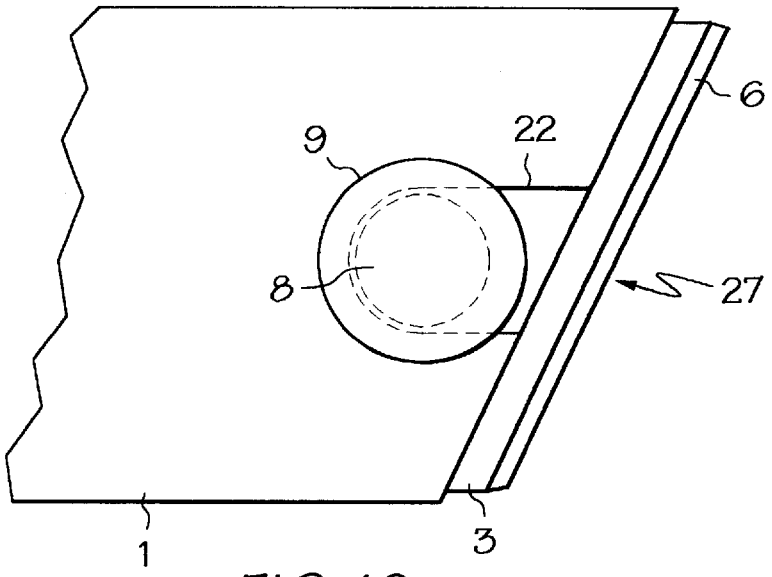
FIG. 10 is an enlarged view of the nail clipping retaining device according to the present invention, mounted to a variation of a typical nail clipper.

FIG. 10 shows an enlarged bottom view of an alternate variation nail clipper 27 having diagonal cutting jaws, together with a nail clipping retaining device 1 mounted to the nail clipper 27. The nail clipping retaining device 1 is mounted to the nail clipper 27 by placing the universal slotted mounting catch 22 in between the stationary spring member 3 and the head 9 of the lever arm pivot pin 8. The tension of the head 9 of the lever arm pivot pin 8 created by both compressed spring members 2 and 3, maintain the nail clipping retaining device 1 in a secure but easily removable position on the nail clipper.

Figure 11:
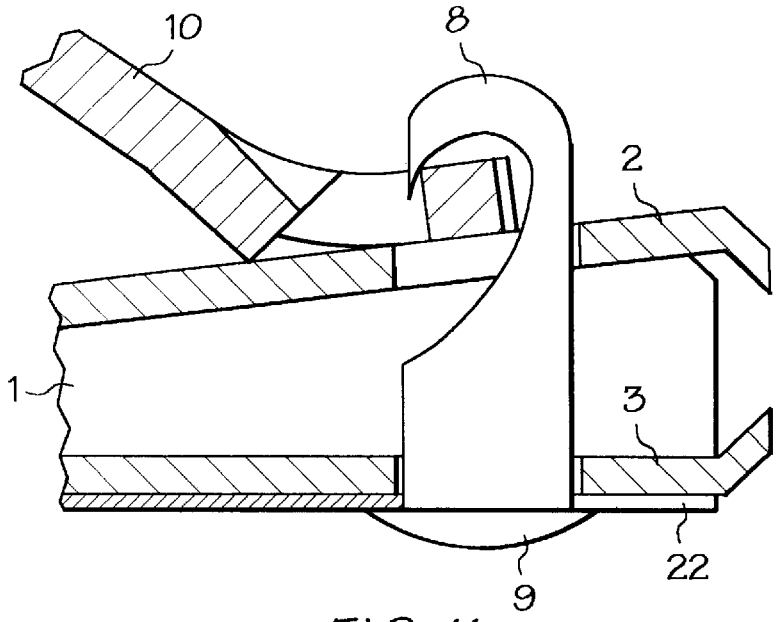
FIG. 11 is a sectional view taken about line 11—11 of a typical nail clipper with the retaining device mounted between the head of the lever arm pivot pin and the lower stationary spring member.
Figure 12:
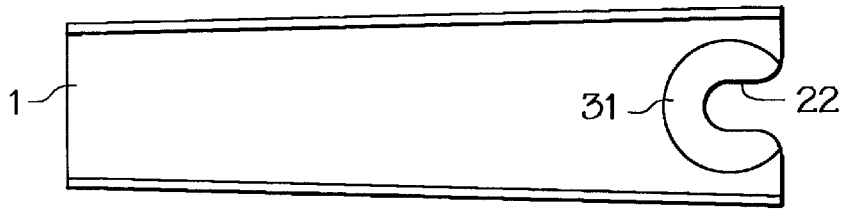
FIG 12 is a bottom view of the nail clipping retaining device wherein the universal slot 22 is reinforced.

FIG. 11 is an enlarged sectional view of the structure that is about line 11—11 in FIG. 9, which illustrates a nail clipper 21 with nail clipping retaining device 1 mounted between stationary spring member 3 and head 9 of pivot pin 8 via universal slotted mounting catch 22.

Operation of Invention

The nail clipping retaining device 1 as shown in FIGS. 1–11 creates a stopping mechanism for projectile nail clippings that are clipped during the manicuring process. Its unique universal slotted mounting system, the slotted mounting catch 22, allows the device to be securely mounted and easily and effortlessly dismounted from a nail clipper 21 between the head 9 of the lever arm pivot pin 8 and the lower stationary spring member 3 for the purpose of emptying accumulated nail clippings, cleaning and sterilization. To remove the nail clipping retaining device 1, one simply raises the rear of the device slightly to clear the protruding rivet 12 at the joined end 4 of the nail clipper 21 and then slides the nail clipping retaining device 1 away from the lever arm pivot pin 8, disengaging the nail clipping retaining device 1 from the nail clipper 21.

By utilizing the universal slotted mounting catch 22, one common design of the nail clipping retaining device 1 can retrofit many different manufacturers nail clippers, allow the nail clipping retaining device 1 to be sold in conjunction with a nail clipper or separately as its own product.

Summary, Ramifications and Scope

The nail clipping retaining device, is a u-shaped elongated channel with the sides of the unshaped channel engineered to cover the side openings of a typical nail clipper. The bottom plate of the unshaped channel contains a slotted mounting catch which allows the nail clipping retaining device to be mounted between the head of the lever arm pivot pin and the lower stationary spring member of a nail clipper with the initially loaded spring force of the cutting mechanism securing the nail clipping retaining device tightly in place against the lower stationary spring member of the nail clipper.

The novel device comprised of a slotted mounting catch and formed of a metal material, and the operation thereof, has not yet been conceived of, and permits the present invention to exist as a separate structure independent of a particular nail clipper. This feature allows the nail clipping retaining device to be marketed and sold by itself or in conjunction with a variety of different nail clippers available on the market.

Although the description in this patent contains many embodiments, these should not be construed as limiting the scope of the invention but as merely providing illustrations of some of the presently preferred embodiments of this invention. For example, additional improvements could be implemented.

A plastic catch could be manufactured, having a metal slotted mounting catch insert washer embedded into sterilizable plastic. The purpose of the washer would be to withstand a large compressive force between the head of the pivot pin and the lower stationary spring member. This could be created for the purposes of reducing costs and changing shapes and colors.

What is claimed is:

1. A nail clipping retaining device to be removably fastened to a nail clipper device of the class which includes a pair of oppositely bowed spring members, an upper movable spring member and a lower stationary spring member, fastened together at a joined end creating an opposing force away from one another at an opposite end when compressed and having a pair of opposing cutting jaw means at said opposite end with an actuating means comprising of a lever arm pivot pin means passing through aligned hole means in said spring members near said opposing cutting jaw means, said aligned hole means being larger than a shaft of said pivot pin means and smaller than a head of said pivot pin means with said head of said pivot pin engaging said lower spring member and under said opposing force of said oppositely bowed spring member, said pivot pin means being coupled to a fulcrumed lever arm means above said upper spring member, creating an initially loaded compressive cutting mechanism means, said nail clipping retaining device comprising:

a u-shaped elongated channel having vertical sides, said lower stationary spring member fitting into said elongated channel, the vertical sides of said elongated channel covering the side openings between said oppositely bowed spring members of said nail clipper, said elongated channel utilizing a fastening means to attach said elongated channel to said nail clipper device; and wherein the elongated channel includes a bottom plate, the fastening means includes a universal slotted mounting catch located on the bottom plate of said elongated channel at one end of said elongated channel closest to said pivot pin means, said slotted mounting catch being slid into position between said stationary spring member and said head of said pivot pin means, said opposing force of said oppositely bowed spring member being applied against said head of said pivot pin means to hold said bottom plate of said nail clipping retaining device securely between said head of said pivot pin means and said stationary spring member.

2. A nail clipping retaining device according to claim 1, wherein said nail clipping retaining device is formed of a material that facilitates effective sterilization.

3. A nail clipping retaining device according to claim 2, wherein said u-shaped elongated channel is made of metal.

4. A nail clipping retaining device according to claim 2, wherein said u-shaped elongated channel is made of plastic, the plastic forming said bottom plate being of sufficient strength to withstand the force exerted on said bottom plate when said bottom plate is being securely held in place between said head of said pivot pin and said lower stationary spring member.

5. A nail clipping retaining device according to claim 2, wherein an area around said universal slotted mounting catch is reinforced to withstand the force exerted on said bottom plate when said bottom plate is being securely held in place between said head of said pivot pin and said lower stationary spring member.

6. A nail clipping retaining device according to claim 2, wherein said u-shaped elongated channel is made of a combination of metal and plastic.

7. A nail clipping retaining device as claimed in claim 1, further including a nail clipper device.

8. A nail clipping retaining device to be removably fastened to a nail clipper device of the class which includes a pair of oppositely bowed spring members, an upper movable spring member and a lower stationary spring member, fastened together at a joined end creating an opposing force away from one another at an opposite end when compressed and having a pair of opposing cutting jaw means at said opposite end with an actuating means comprising of a lever arm pivot pin means passing through aligned hole means in said spring members near said opposing cutting jaw means, said aligned hole means being larger than a shaft of said pivot pin means and smaller than a head of said pivot pin means with said head of said pivot pin engaging said lower spring member and under said opposing force of said oppositely bowed spring member, said pivot pin means being coupled to a fulcrumed lever arm means above said upper spring member, creating an initially loaded compressive cutting mechanism means, said nail clipping retaining device comprising:

a u-shaped elongated channel having vertical sides, said lower stationary spring member fitting into said elongated channel, the vertical sides of said elongated channel covering the side openings between said oppositely bowed spring members of said nail clipper, said elongated channel utilizes a fastening means to attach said elongated channel to said nail clipper device;

the elongated channel includes a bottom plate, the fastening means includes a universal slotted mounting catch located on the bottom plate of said elongated channel at one end of said elongated channel closest to said pivot pin means, said slotted mounting catch being slid into position between said stationary spring member and said head of said pivot pin means, said opposing force of said oppositely bowed spring members being applied against said head of said pivot pin means to hold said bottom plate of said nail clipping retaining device securely between said head of said pivot pin means and said stationary spring member; and said universal slotted mounting catch being reinforced to withstand the force exerted on said bottom plate when said bottom plate is being securely held in place between said head of said pivot pin and said lower stationary spring member.

* * * * *